US005149455A

United States Patent [19]

Jacobs et al.

[11] Patent Number: 5,149,455

[45] Date of Patent: Sep. 22, 1992

[54] PROCESS FOR INCREASING THE DENSITY OF SPRAY DRIED, PHOSPHATE-REDUCED DETERGENTS

[75] Inventors: Jochen Jacobs, Wuppertal; Ulrich Jahnke, Monheim; Dieter Jung, Hilden; Rudolf Oleffelmann, Langenfeld; Wilfried Adler, Haan, all of Fed. Rep. of Germany

[73] Assignee: Henkel Kommanditgesellschaft auf Aktien, Duesseldorf-Holthausen, Fed. Rep. of Germany

[21] Appl. No.: 644,469

[22] Filed: Jan. 18, 1991

Related U.S. Application Data

[63] Continuation of Ser. No. 335,904, Apr. 10, 1989, abandoned.

[30] Foreign Application Priority Data

Apr. 15, 1988 [DE] Fed. Rep. of Germany ..... 3812530

[51] Int. Cl.[5] ..... C11D 1/02; C11D 1/66

[52] U.S. Cl. ..... 252/174.13; 252/174; 252/174.25

[58] Field of Search ..... 252/174, 174.13, 174.25

[56] References Cited

U.S. PATENT DOCUMENTS

| | | | |
|---|---|---|---|
| 3,360,865 | 2/1965 | Galle et al. | 34/10 |
| 3,870,522 | 3/1975 | Moisar et al. | 96/107 |
| 3,886,098 | 5/1975 | Di Salvo et al. | 252/540 |
| 3,966,629 | 6/1976 | Dumbrell | 252/140 |
| 4,006,110 | 2/1977 | Kenney et al. | 252/540 |
| 4,062,647 | 12/1977 | Storm et al. | 8/137 |
| 4,144,226 | 3/1979 | Crutchfield et al. | 528/231 |
| 4,146,495 | 3/1979 | Crutchfield et al. | 252/89 |
| 4,320,105 | 3/1982 | Nelli et al. | 423/421 |
| 4,552,681 | 11/1985 | Koch et al. | 252/140 |
| 4,639,326 | 1/1987 | Czempik et al. | 252/91 |
| 4,663,194 | 5/1987 | Wixon et al. | 427/214 |
| 4,675,124 | 6/1987 | Seiter et al. | 252/91 |
| 4,713,193 | 12/1987 | Tai | 252/91 |
| 4,849,125 | 7/1989 | Seiter et al. | 252/109 |
| 4,869,843 | 9/1989 | Saito et al. | 252/135 |
| 4,931,203 | 6/1990 | Ahmed et al. | 252/99 |
| 4,970,017 | 11/1990 | Nakamura et al. | 252/174.13 |
| 4,992,198 | 2/1991 | Nebashi et al. | 252/174.11 |
| 4,999,138 | 3/1991 | Nebashi et al. | 252/543 |

FOREIGN PATENT DOCUMENTS

| | | |
|---|---|---|
| 0026529 | 4/1981 | European Pat. Off. . |
| 2548639 | 5/1976 | Fed. Rep. of Germany . |
| 61-69897 | 4/1986 | Japan . |
| 61-69898 | 4/1986 | Japan . |
| 61-69899 | 4/1986 | Japan . |
| 61-69900 | 4/1986 | Japan . |

OTHER PUBLICATIONS

Drawings showing Lodige mixer (2 sheets).

Chemical Engineers' Handbook, pp. 21-32, 21-33 (5th ed.).

*Primary Examiner*—Paul Lieberman

*Assistant Examiner*—Kery A. Fries

*Attorney, Agent, or Firm*—Wayne C. Jaeschke; John E. Drach; Daniel S. Ortiz

[57] ABSTRACT

The density of a spray-dried, phosphate-reduced detergent powder containing

A) 4 to 20% by weight of at least one anionic surfactant,

B) 2 to 20% by weight of at least one nonionic surfactant,

C) 20 to 50% by weight of at least one builder,

D) 3 to 25% by weight washing alkalis,

E) 0 to 30% by weight of other detergent constituents which lend themselves to hot spray drying is increased by continuously introducing a detergent powder having up to 50% of the final amount of nonionic surfactant into a cylindrical, horizontally arranged mixing drum in which a shaft is mounted for axial rotation. The shaft is equipped with radially arranged impact tools of defined length. The rotational speed of the shaft is regulated to provide a Froude index of from 50 to 1000.

10 Claims, No Drawings

PROCESS FOR INCREASING THE DENSITY OF SPRAY DRIED, PHOSPHATE-REDUCED DETERGENTS

This application is a continuation, of application Ser. No. 07/335,904 filed on Apr. 10, 1989 now abandoned.

BACKGROUND OF THE INVENTION

1. Field of the Invention

This invention relates to a process for increasing the density of spray-dried, phosphate-reduced detergents.

2. Description of the Related Art

Spray-dried detergents of standard composition generally have apparent densities of 250 to 450 g/l (grams per liter) and, only in exceptional cases, of 480 g/l, depending on composition and procedure. In recent years, increasing interest has been shown in powders having higher apparent densities, for example in the range from 550 to 750 g/l, because they require less packaging material and, hence, provide for a saving of raw materials and a reduction in waste.

In addition, spray-dried detergents having apparent densities of from 550 to 900 g/l and processes for their production are known, for example in U.S. Pat. No. 4,552,681. However, the compositions in question here are special compositions rich in nonionic surfactants. An addition of anionic surfactants, particularly soaps, produces a marked reduction in apparent density to values below 500 g/l. The build-up granulation of individual detergent constituents in the presence of granulation liquids, such as water or alkali silicate solutions, also promotes high apparent densities. However, granulation with water generally requires the presence of relatively large amounts of salts which bind water of crystallization, mainly phosphates, such as tripolyphosphate, or soda. However, this also restricts freedom of formulation and complicates the production of P-free and P-reduced detergents. The spraying of nonionic detergents onto spray-dried or granulated powder also increases its apparent density, although the increase generally remains minimal. However, if relatively large amounts are used, the granulates are in danger of becoming tacky unless highly absorbent starting powders of special composition are used which again restricts freedom of formulation.

DE-A-25 48 639 describes a process for increasing the apparent density of granulated or spray-dried detergents in an apparatus which is known among experts as a "Marumerizer" and which is normally used to round off extruded particles of irregular shape. This apparatus consists of an upright cylinder having smooth side walls and a surface-roughened rotary plate which rotates in the lower part of the cylinder. It is primarily intended for intermittent operation. The largest available plants of this type, in which the rotary plate has a diameter of approximately 1 m, are only capable of accommodating a batch of at most 45 to 50 kg tower powder. For a residence time of approximately 10 minutes of the powder in the apparatus according to Example 3 of the cited DE-A, the throughput, based on an average hourly output of an average spray-drying tower of 5 to 25 t (tonnes), is far too low so that a very large number of "Marumerizers" constantly in operation would be necessary to keep pace with the tower output. On the other hand, it is uneconomical to operate the tower, including the expensive heating system, on only an intermittent basis and thus to adapt it to the low output of the granulator. Nor is it advisable to use the tower only sporadically for the production of the pregranulate, to store the pregranulate and to use the tower otherwise in the meantime. This is because, according to DE-A-25 48 639, the pregranulate or spray-dried powder must be subsequently processed as soon as possible, i.e. within a matter of minutes, in the "Marumerizer" to obtain a significant increase in powder density.

Accordingly, the object of the present invention is to avoid the disadvantages mentioned above and to provide a process which runs continuously, allows relatively high throughputs and relatively short residence times, guarantees maximal flexibility in regard to the quantity, physical condition and composition of the spray-dried powder and the production time and requires minimal capital investment and energy consumption.

DETAILED DESCRIPTION OF THE INVENTION

Other than in the operating examples, or where otherwise indicated, all numbers expressing quantities of ingredients or reaction conditions used herein are to be understood as modified in all instances by the term "about". The present invention, which achieves this object, relates to a process for increasing the density of a spray-dried, phosphate-reduced detergent powder containing A) 4 to 20% by weight of at least one anionic surfactant,
B) 2 to 20% by weight of at least one nonionic surfactant,
C) 20 to 50% by weight of at least one builder,
D) 3 to 25% by weight washing alkalis,
E) 0 to 30% by weight of other detergent constituents which lend themselves to hot spray drying, comprising the steps of:

(1) continuously introducing a spray-dried phosphate reduced detergent tower powder, said tower powder containing up to about the half of the amount of component (B) and at most 5% by weight related to the final detergent powder of the nonionics surfactant and having an apparent density of at least 350 g/liter into a cylindrical, substantially horizontal mixing drum having a smooth inner wall and having a shaft mounted for axial rotation about a central axis equipped with radially arranged impact tools having a length (from the central axis) between about 80% and about 98% of the internal radius of the drum and regulating the rotational speed of the shaft to a Froude index of from about 50 to about 1OOO for a mean residence time of the tower powder in the drum of 1O to 60 seconds and a constant powder throughput, and (2) continuously introducing the remainder of the amount of the nonionic surfactant in the liquid state into the mixer.

The detergents contain as component A) from 4 to 20% by weight and preferably from 5 to 15% by weight of at least one anionic surfactant from the class of soaps, sulfonates and sulfates.

Suitable soaps are derived from natural or synthetic, saturated or monounsaturated fatty acids containing from 12 to 22 carbon atoms. Particularly suitable soaps are soap mixtures derived from natural fatty acids, for example from coconut oil, palm kernel or tallow fatty acids. Soap mixtures of which 50 to 100% consist of saturated $C_{12-18}$ fatty acid soaps and 0 to 50% of oleic acid soap are preferred. They preferably make up from 8 to 15% by weight of the detergent.

Suitable surfactants of the sulfonate type are linear alkyl benzenesulfonates ($C_{9-13}$alkyl) and olefin sulfonates, i.e. mixtures of alkene sulfonates and hydroxyalkane sulfonates and also disulfonates of the type obtained, for example, from $C_{12-18}$ a monoolefins containing a terminal or internal double bond by sulfonation with gaseous sulfur trioxide and subsequent alkaline hydrolysis of the sulfonation products. Other suitable surfactants of the sulfonate type are alkane sulfonates, of the type obtainable from $C_{12-18}$ a alkanes by sulfochlorination or sulfoxidation and subsequent hydrolysis or neutralization, and also α-sulfonated hydrogenated coconut oil, palm kernel or tallow fatty acids and their methyl or ethyl esters and also mixtures thereof.

Suitable surfactants of the sulfate type are the sulfuric acid monoesters of primary alcohols of natural and synthetic origin, i.e. of fatty alcohols, such as for example coconut oil fatty alcohols, tallow fatty alcohols, oleyl alcohol, lauryl, myristyl, palmityl or stearyl alcohol, or the $C_{10-18}$ a oxoalcohols and also the sulfuric acid esters of secondary alcohols having the same chain length. The sulfuric acid monoesters of primary alcohols or alkylphenols ethoxylated with 1 to 3 mol ethylene oxide are also suitable. Sulfatized fatty acid alkanolamides and sulfatized fatty acid monoglycerides are also suitable.

Surfactants containing sulfonate groups are preferred and, among these, the alkyl benzenesulfonates, α-sulfofatty acid ester salts and α-sulfofatty acid ester disalts are particularly preferred. The anionic surfactants are normally present in the form of their sodium salts. They preferably make up from 5 to 15% by weight of the detergent.

Suitable nonionic surfactants (component B) are adducts of 2 to 20 and preferably 3 to 15 mol ethylene oxide (EO) with 1 mol of a compound essentially containing from 10 to 20 carbon atoms and more especially from 12 to 18 carbon atoms from the group of alcohols. Suitable nonionic surfactants are derived from primary alcohols, for example coconut oil or tallow fatty alcohol, oleyl alcohol, oxoalcohol, or from secondary alcohols containing from 8 to 18 and preferably from 12 to 18 C atoms. Combinations of water-soluble nonionic surfactants (component B1) and water-insoluble or water-dispersible nonionic surfactants (component B2) are preferred. Component B1 includes those containing from 6 to 15 EO and having an HLB value of more than 11 while component B2 includes those containing from 2 to 6 EO and having an HLB value of 11 or less. It has been found to be of advantage completely to add component B2 to the already spray-dried powder in the mixer. Component B1 may be both completely or partly co-sprayed and completely or partly added in the mixer.

The nonionic surfactants may also contain propylene glycol ether groups (PO). These groups may be terminally arranged or statistically distributed with the EO groups. Preferred compounds of this class are those of the type $R\text{-}(PO)_x\text{-}(EO)_y$, in which R represents the hydrophobic radical, x is a number of 0.5 to 3 and y is a number of 3 to 20.

Other suitable nonionic surfactants are, optionally, ethoxylates of alkylphenols, 1,2-diols, fatty acids and fatty acid amides and also block polymers of polypropylene glycol and polyethylene glycol or alkoxylated alkylenediamines (of the Pluronics and Tetronics type). In addition, the above-described nonionic surfactants of the EO type may be partially replaced by alkyl polyglcosides. Suitable alkyl polyglycosides contain, for example, a $C_8$–$C_{16}$ alkyl radical and an oligomeric glycoside residue containing from 1.5 to 6 glucose groups. Surfactants of the alkyl glycoside type are preferably incorporated in the spray-dried powder.

The detergents contain from 2 to 15% by weight, preferably from 3 to 12% by weight and more preferably from 4 to 10% by weight of nonionic surfactants or nonionic surfactant mixtures.

Component (C) consists of finely crystalline, synthetic, water-containing zeolites of the NaA type which have a calcium binding power of from 100 to 200 mg CaO/g (as measured in accordance with DE 22 24 837). Their particle size is normally in the range from 1 to 10 μm. The content of these zeolites in the detergents is from 10 to 40% by weight and preferably from 15 to 35% by weight. The zeolite may be largely or even completely incorporated in the spray-drying mixture and sprayed therewith. It is of greater advantage to add a proportion thereof in powder form during the mixing process. This proportion may be up to 5% by weight, based on the detergent and is preferably between 1 and 4% by weight. This procedure leads to a further increase in apparent density and, at the same time, improves the flow behavior of the detergent.

The zeolite is preferably used together with polyanionic co-builders. Polyanionic co-builders are compounds from the class of polyphosphonic acids and of homopolymeric or copolymeric polycarboxylic acids derived from acrylic acid, methacrylic acid, maleic acid and olefinically unsaturated, copolymerizable compounds.

Preferred phosphonic acids or phosphonic acid salts are 1-hydroxyethane-1,1-diphosphonate, ethylenediamine tetramethylene phosphonate (EDTMP) and diethylenetriamine pentamethylene phosphonate, generally used in the form of their sodium salts and mixtures. The quantities used, expressed as free acid, are normally up to 1.5% by weight, based on the detergents, and preferably between 0.1 and 0.8% by weight.

Other suitable co-builders are aminopolycarboxylic acids, particularly nitrilotriacetic acid, also ethylenediamine tetraacetic acid, diethylenetriamine pentaacetic acid and higher homologs thereof. They are generally present in the form of the sodium salts. They may be present in the detergent in a quantity of up to 2% by weight and, in the case of nitrilotriacetic acid, in a quantity of up to 10% by weight.

Other suitable co-builders are homopolymers of acrylic acid and methacrylic acid, copolymers of acrylic acid with methacrylic acid and copolymers of acrylic acid, methacrylic acid or maleic acid with vinyl ethers, such as vinyl methyl ether or vinyl ethyl ether, also with vinyl esters, such as vinyl acetate or vinyl propionate, acrylamide, methacrylamide and with ethylene, propylene or styrene. In copolymeric acids such as these, in which one of the components does not bear an acid function, their content is no more than 70 mol-% and preferably less than 60 mol-% in the interests of adequate solubility in water. Copolymers of acrylic acid or methacrylic acid with maleic acid, of the type characterized for example in EP 25 551-B 1, have proved to be particularly suitable. The copolymers in question are copolymers containing from 50 to 90% by weight acrylic acid. Copolymers in which from 60 to 85% by weight acrylic acid and from 40 to 15% by weight maleic acid are present and which have a molecular weight of from 30,000 to 120,000 are particularly preferred.

Polyacetal carboxylic acids, of the type described for example in U.S. Pat. Nos. 4,144,226 and 4,146,495 and obtained by polymerization of esters of glycolic acid, introduction of stable terminal groups and saponification to the sodium or potassium salts, may also be used. Polymeric acids obtained by polymerization of acrolein and Canizzaro disproportionation of the polymer using strong alkalis are also suitable. They are essentially made up of acrylic acid units and vinyl alcohol units or acrolein units.

The proportion of (co)polymeric carboxylic acids or salts thereof may be up to 8% by weight and is preferably between 1 and 6% by weight, based on acid.

By virtue of their complexing and precipitation retarding properties (so-called threshold effect), the cobuilders mentioned prevent the formation of fiber incrustations and improve the soil-dissolving and soil-dispersing properties of the detergents.

The detergents are preferably phosphate-free. However, in cases where this is acceptable or permissible on ecological grounds, part of the zeolite and part of the cobuilders may also be replaced by polyphosphates, particularly sodium tripolyphosphate (Na-TPP). However, the Na-TPP content should be no more than 25% by weight, preferably less than 20% by weight and more preferably between 0 and at most 5% by weight. The Na-TPP may be co-sprayed with the spray-dry mixture, in which case partial hydrolysis to pyrophosphate and orthophosphate generally occurs. Accordingly, it can be of advantage to introduce it into the mixer in powder form together with the sprayed powder and to process it therewith.

Suitable washing alkalis (component D) are alkali metal silicates, particularly sodium silicates having the composition $Na_2O:SiO_2=1:1$ to 1:3.5 and preferably 1:2 to 1:3.35. They may make up from 0.5 to 6% by weight and more especially from 1 to 3% by weight of the detergents. The sodium silicate improves the grain stability and the grain structure of the powder-form or granular detergents and has a favorable effect on the dispensing and dissolving behavior of the detergents where they are used in automatic washing machines. In addition, it has an anti-corrosive effect and improves washing power. Although it is known that relatively large proportions, i.e. of more than 2 to 3% by weight, of alkali silicates in zeolite-containing detergents lead to agglomeration of the zeolite particles which are deposited on the fabrics and increase their ash value and can spoil their appearance, this adverse effect is largely eliminated where cobuilders, particularly copolymeric carboxylic acids, are present and the content of sodium silicate required for the reasons mentioned can be increased without any of the above-stated disadvantages.

Other suitable washing alkalis (component D) include sodium carbonate which may make up 15% by weight, preferably between 2 and 12% by weight and more preferably between 5 and 10% by weight. The total quantity of sodium silicate and sodium carbonate is between 4 and 20% by weight, preferably between 5 and 10% by weight and more preferably between 7 and 12% by weight.

The other constituents (component E), which make up from 0 to 30% by weight and preferably from 1 to 25% by weight, include redeposition inhibitors (soil suspending agents), fabric softeners, dyes and perfumes and also neutral salts, such as sodium sulfate and water.

As a constituent of component (E), the detergents may contain redeposition inhibitors which keep the soil detached from the fibers suspended in the liquor and thus prevent redeposition. Suitable redeposition inhibitors are cellulose ethers, such as carboxymethyl cellulose, methyl cellulose, hydroxyalkyl celluloses, and mixed ethers, such as methyl hydroxyethyl cellulose, methyl hydroxypropyl cellulose and methyl carboxymethyl cellulose. Other suitable redeposition inhibitors are mixtures of various cellulose ethers, particularly mixtures of carboxymethyl cellulose and methyl cellulose or methyl hydroxyethyl cellulose. They preferably make up from 0.3 to 3% by weight.

Suitable optical brighteners are alkali salts of 4,4-bis-(2''-anilino-4''-morpholino-1,3,4-triazinyl-6''-amino)-stilbene-2,2'-disulfonic acid or compounds of similar structure which bear a diethanolamino group instead of the morpholino group. Other suitable optical brighteners are brighteners of the substituted diphenyl styryl type, for example the alkali salts of 4,4'-bis-(2-sulfostyryl)-diphenyl, 4,4'-bis-(4-chloro-3-sulfostyryl)-diphenyl and 4-(4-chlorostyryl-4'-(2-sulfostyryl)-diphenyl. They are normally present in quantities of 0.1 to 1% by weight.

Suitable fabric softeners are layer silicates from the class of bentonites and smectites, for example those according to DE 23 34 899 and EP 26 529. Other suitable fabric softeners are synthetic finely divided layer silicates having a smectite-like crystal phase and reduced swelling power and corresponding to the following formula $$MgO(M_2O)_a(Al_2O_3)_b(SiO_2)_c(H_2O)_n$$

in which M=sodium, optionally together with lithium, with the proviso that the molar ratio of Na to Li is at least 2, a=0.05 to 0.4, b=0 to 0.3, c=1.2 to 2 and n=0.3 to 3, $(H_2O)_n$ standing for the water bound in the crystal phase. Other suitable fabric softeners are synthetic layer silicates which, after suspension in water (16° German hardness, room temperature), have a swelling power $V_s/V$ - determined as the quotient of the sediment volume $(V_s)$/total volume (V) after preliminary treatment with excess soda solution, careful washing and 20 hours after suspension in 9 parts by weight water/1 part by weight layer silicate—of less than 0.6 and more especially less than 0.4, and also synthetic layer silicates which have a mixed crystalline structure and comprise structure-determining saponite-like and/or hectorite-like crystal phases which are irregularly permeated by crystalline alkali polysilicate. Layer silicates such as these are characterized in detail in DE 35 26 405. The content of layer silicates may be, for example, from 5 to 20% by weight.

Other suitable softening additives are long-chain fatty acid alkanolamides and dialkanolamides and also reaction products of fatty acids or fatty acid diglycerides with 2-hydroxyethyl ethylenediamine and also quaternary ammonium salts which contain from 1 to 2 alkyl chains containing from 12 to 18 C atoms and 2 short-chain alkyl radicals or hydroxyalkyl radicals, preferably methyl radicals. These softening additives are preferably added to the powder together with the nonionic surfactants in the mixer, for example in proportions of up to 10% by weight and preferably in proportions of 0.5 to 5% by weight, based on the detergent.

The spray drying of the powder to be processed is carried out in known manner by spraying a slurry under high pressure through nozzles and passing hot combustion gases in countercurrent in a drying tower.

In the interests of the high final density required, the spray-dried powder leaving the drying tower (hereinafter referred to in short as the "tower powder") should have an initial density (weight per liter) of at least 350 g/l. The density of the tower powder is at least 400 g/l. Tower powders of low specific gravity, for example those containing zeolite, can be compacted to a higher density than those which already have a high initial density, although overall their final weight is lower than that of the relatively heavy tower powders.

Neither the grain size nor the grain size distribution of the tower powder has to satisfy particular requirements. On the contrary, powders having a broad grain size distribution and those having a narrow grain size distribution may be processed by the process according to the invention. Nor is there any need for coarse grain components to be sifted off from the tower powder beforehand, as is necessary with conventional powders. Instead, the process according to the invention size-reduces coarse components, compresses loose voluminous components, rounds off irrregularly shaped constituents and compacts "fines". Overall, the process according to the invention reduces average grain size.

The powder leaving the tower may be immediately processed in accordance with the invention. The temperature of the powder is not critical per se, particularly when it is thoroughly dried, i.e. when its water content corresponds to, or is below, the theoretical water-binding capacity. However, in the case of plastic powders, particularly powders of relatively high water content, it should not exceed 50° C., preferably 40° C., being the level which is generally established when the powder is pneumatically transported. However, the powder may also be stored indefinitely although in general this is only a factor in the event of production stoppages. Advantageously, there is always a continuous flow of material, for which the process according to the invention is particularly suitable by virtue of the continuous procedure involved.

The powder should be free-flowing and non-tacky. However, it is also possible to use slightly tacky powders providing water-soluble, moisture-adsorbing salts or a finely divided adsorbent material is introduced into the mixer at the same time. Suitable salts are, for example, sodium sulfate, soda or phosphates or polyphosphates which may be added in proportions of up to 20% by weight and preferably in proportions of up to 10% by weight. Suitable adsorbents are zeolite and finely divided silica. It is preferred to add finely divided zeolite NaA having a maximum particle size of 10 μm in quantities of up to 4% by weight and preferably in quantities of from 0.5 to 3% by weight.

The mixer used to carry out the process consists of an elongate mixing drum substantially cylindrical in shape which is mounted horizontally or inclined moderately downwards to the horizontal and which is equipped with at least one filling spout or funnel and a discharge opening. Arranged inside the mixing drum is a central rotatable shaft which carries several radially oriented impact tools. These impact tools are intended to be separated by a certain interval from the smooth inner wall of the drum during its rotation. The length of the impact tools should be between 80% and 98% and preferably between 85% and 95% of the internal radius of the mixing drum.

The impact tools may have any shape, i.e. they may be straight or angled, of uniform cross-section or pointed, rounded or widened at their ends. Their cross-section may be circular or square with rounded edges. Tools of different shape may also be combined. Tools which have been successfully used are those of drop- or wedge-shaped cross-section, one flat or rounded surface facing in the direction of rotation because, with tools such as these, the compacting effect outweighs the size-reducing effect. To avoid imbalances, the tools may be arranged on the shaft diametrically in pairs or in the shape of a star. A spiral arrangement has proved to be advantageous. Although the number of tools is not critical, it is advisable in the interests of high efficiency to arrange them at intervals of 5 to 25 cm. It is also of advantage to mount them for rotation on the shaft so that it is possible to influence the horizontal transport of the material being mixed by adjusting one flat side of the tools at an oblique angle in the direction of material flow. Nor do the tools have to be uniform in shape, instead it is possible to arranged tools having more of a compacting and more of a transporting effect in alternation.

The transport of the material being mixed in the mixer can also be effected or rather accelerated by additional transport blades. These transport blades may be arranged individually or in pairs between the mixing tools. The degree of transport can be regulated through the pitch angle of the blades.

Depending on the desired throughput, the internal radius of the mixer is best between 10 and 60 cm and preferably between 15 and 50 cm, its internal length is between 70 and 400 cm and preferably between 80 and 300 cm and the ratio of internal length to internal radius is from 4:1 to 15:1 and preferably between 5:1 and 10:1. With these dimensions, the number of impact tools is normally between 10 and 100 and mostly between 20 and 80. The inner wall of the cylinder should be smooth to avoid unwanted adhesion of the powder. With smaller dimensions, the rotational speed of the shaft, taking the Froude index (hereinafter defined) into account, is above 800 r.p.m. (revolutions per minute) and mostly between 1000 and 3000 r.p.m. With larger mixers, it may be reduced accordingly.

The residence time of the powder in the mixer depends on the efficiency of the plant and on the intensity of the desired effect. It should be no less than 10 seconds and no more than 60 seconds and is preferably between 20 and 50 seconds. It may be influenced by the inclination of the mixer, by the shape and arrangement of the impact and transport tools and, to a certain extent, also by the quantity of powder introduced and removed. Thus, it is possible by reducing the exit cross-section to create a certain back pressure and hence to lengthen the residence time in the mixer. The mixer should be operated in such a way that, after the startup phase, there is a constant throughput of powder, i.e. the quantity of powder introduced and removed is always equally large and constant.

A crucial measure of the operation of the mixer is the Froude index, a dimensionless value defined by the following relation:

$$\frac{w^2 \cdot r}{g}$$

where w is the angular speed, r is the length of the tools from the central axis and g is the earth's acceleration. The Froude index should be between 50 and 1200, preferably between 100 and 800 and more preferably between 250 and 500.

The powder can undergo slight heating in consequence of its mechanical treatment. However, additional cooling is generally only necessary, if at all, if the powder introduced tends to adhere at elevated temperature. However, this problem may advantageously be solved by adequately cooling the tower powder beforehand, for example during its pneumatic transport.

The nonionic surfactant is fed into the mixer in the region where the powder undergoes intensive mechanical treatment. It has proved to be of advantage in this regard to arrange the inlets in the wall of the mixer. The otherwise typical arrangement of short spray nozzles in the hollow shaft necessitates the use—at low rotational speeds—of spray nozzles which operate under excess pressure or which are operated on the principle of the perfume atomizer with compressed air. This procedure necessitates additional expense on pressure pumps and dust separators for the compressed air discharged from the mixer. The arrangement of the inlets in the mixer wall requires no such investment. The nonionic surfactant introduced can spread out over the inner wall and is continuously taken up by powder impinging on the wall, distributed and adsorbed. Providing the nonionic surfactant does not have to be introduced through the hollow shaft for design reasons, the exit nozzles arranged on the hollow shaft are advantageously extended to such an extent that they project into the powder stream. As a result of the increased centrifugal forces, the nonionic surfactant can be transported and atomized without compressed air, being subsequently distributed and taken up by the powder stream. The number of inlets is best from 1 to 10. Where they are arranged in the cylinder wall, the inlets are preferably situated laterally in the region of the ascending powder stream. Where several inlets are arranged one behind the other, the last should be installed so far in front of the outlet opening that the issuing nonionic surfactant is still homogeneously distributed.

The nonionic surfactant is introduced in liquid form. Relatively high melting compounds are melted beforehand and introduced at temperatures above the melting point. The moving powder also best has a minimum temperature which is in the vicinity of, or above, the melting point of the nonionic surfactant. This temperature range may readily be adjusted by suitable guiding of the product after spray drying.

The nonionic surfactant may be introduced into the powder in this way overall. It is also possible to add part of the nonionic surfactant to the spray dry mixture and only to introduce the remainder through the mixer. Basically, however, surfactants having a low degree of ethoxylation (low HLB value corresponding to component B2) should be incorporated solely via the mixer. The proportion introduced through the tower powder should amount to at most 50% by weight, based on nonionic surfactant. The proportion of nonionic surfactant present in the detergent which is introduced through the mixer is best between 0.5 and 6% by weight and more especially between 1 and 5% by weight.

Providing the conditions stated above are observed, the process may be continuously carried out with high throughputs free from interruptions. The process taking place in the mixer may be described as follows:

The powder introduced is entrained by the rotating impact tools and impinges on, but does not remain adhering to, the inner wall of the mixer even if the inner wall of the mixer is covered in the meantime by a thin film of nonionic surfactants. This film is continuously broken up by the vigorously agitated powder and is adsorbed thereto. At best, a thin powder covering is briefly formed, but is continuously renewed and always allows the smooth inner surface of the mixer to appear. Accordingly, the powder particles describe a helical movement from the mixer entrance to the mixer exit. If the powder adheres to the inner wall for a relatively long time, forming a layer of powder which has to be scraped off the rotating tools, the powder is too moist or too tacky or even too warm or the quantity of nonionic surfactant locally introduced is too high. The effect of this non-stationary state is that the material being mixed overheats and clogs the mixer. The formation of such coatings can be prevented by the described addition of adsorbents.

The products obtained have an apparent density higher by 50 to 200 g/l than that of the tower powder used, show excellent free flow and do not have to be after-treated, more especially dried or sieved to remove oversize or lumpy agglomerates. Accordingly, they may be packed in transport containers immediately after leaving the mixer, optionally after incorporation of other powder constituents, such as bleaches (for example sodium perborate as monohydrate or tetrahydrate), bleach activators (for example granulated tetraacetyl ethylenediamine), enzyme granulates, foam inhibitors (for example silicone or paraffin inhibitors applied to support material). It is of course also possible to treat two or more separately prepared tower powders of different composition in the mixer and to compact only one of them or subsequently to add a second.

EXAMPLES

The mixer used was a horizontally arranged mixer of which the cylindrical interior had a radius of 15 cm and an internal length of 125 cm. Several transport blades were spirally arranged in the entry zone (length 30 cm). Arranged spirally on the inner wall in the following mixing zone between entrance and exit were, first, 5 pointed mixing tools angled downwards at their ends and then another 25 mixing tools of wedge-shaped cross-section with rounded corners. The interval between the tools and the inner wall of the cylinder was 0.5 cm, giving a ratio of tool length (from the central axis) to the inner wall of the mixer of 96.7% of the internal radius. To support the transporting effect, obliquely inclined transport blades (10 in all) were arranged spirally between the mixing tools. A total of four inlets (approx. 10 cm in diameter), through which the nonionic component (b) was fed into the mixer, was laterally arranged at intervals of 10 cm in the wall of the mixer in the first third of the mixing zone in the region of the ascending powder stream. The size of the outflow opening could be regulated by means of a slide. In Examples 1 to 4 below, the slide was adjusted in such a way that a slight back pressure was built up in operation, ensuring a uniform filling level in the mixer. In Examples 1 to 4, the rotational speed was 1500 r.p.m. and the mean residence time between 20 and 60 seconds, on average between 30 and 40 seconds. The mixer was charged with the spray-dried powder which, after leaving the tower outlet, was transported by a pneumatic conveyor and had a temperature of approximately 30° C. or, after intermediate storage, a temperature of 20° to 25° C.

The composition of the powder, the Froude index and the throughput in tonnes per hour (t/h) and also the weight per liter before and after the treatment are shown in Table I.

In Examples 1 to 3, constituents a and d to k and also the water and most of the sodium sulfate (constituent l) fell to the tower powder. The nonionic surfactant (constituent b) heated to 45° C. was introduced into the mixer through the lateral inlets. In Examples 1 and 2, a mixture of constituent b and most (2% by weight) of constituent c was introduced in the same way. The remainder of constituent c (0.3% by weight) was present in the tower powder. The remainder of the sodium sulfate and the minor constituents served as granulation base and as coating substances for constituents p to r which were subsequently added to and mixed with the treated powder together with the perborate (m,n) (which had been sprayed with perfume). The resulting apparent density of the final mixture A is also shown (in g/liter).

In another series of tests, 2% zeolite was eliminated from the tower powder formulation and, instead, was added as a powder during the mixing process. End products B of even higher apparent density were obtained.

In Example 4, 43 parts by weight tower powder comprising components a, c, d, g, h, i, k and part of component l and also 52% of component e and 74% of component f were processed with 2 parts by weight of component b) in the mixer in the same way as described in Examples 1 to 3. The remainders of components e and f and also parts of component l (sodium sulfate, water) were present as spray-dried granulate which was impregnated with the remainder of component b). This granulate (29 parts by weight) was subsequently added together with components m to r (28 parts by weight) to the tower powder (43 parts by weight) treated in the mixer. A powder mixture of outstanding pourability which did not require aftertreatment (dusting) with finely divided zeolite was obtained.

The abbreviations used have the following meanings:
Na-ABS sodium dodecyl benzenesulfonate (C10–13)
FA+x EO fatty alcohol+x mol added ethylene oxide
STP sodium tripolyphosphate (anhydrous)
AA-MA acrylic acid:maleic acid 3:1 (MW 70,000)
Phosphonate ethylenediamine tetramethylene phosphonic acid $Na_6$ salt
NTA nitrilotriacetic acid $Na_3$ salt
TAED tetraacetyl ethylenediamine The powders were pourable, did not emit dust and dissolved quickly and completely without clumping both when scattered by hand into the wash liquor and when sprayed automatically into domestic washing machines. In a shaking test, which simulated a mechanical load applied during transportation of the packs, no separation of the powder components occurred.

-continued

| Composition | | 1 | 2 | 3 | 4 |
|---|---|---|---|---|---|
| a | Na—ABS | 7.0 | 6.9 | 7.0 | 7.0 |
| b | $C_{12-14}$—FA + 3 EO | 2.5 | 4.1 | 4.25 | 4.3 |
| c | $C_{12-18}$—FA + 7 EO | 2.3 | 2.3 | — | 0.3 |
| d | soap | 0.5 | 0.5 | 0.8 | 0.8 |
| e | zeolite NaA | 25.0 | 24.6 | 26.4 | 25.5 |
| f | AA—MA copolymer | 4.0 | 3.9 | 4.0 | 4.0 |
| g | phosphonate | 0.6 | 0.6 | 0.2 | 0.2 |
| h | $Na_2CO_3$ | 7.0 | 6.9 | 14.3 | 9.3 |
| i | $Na_2O.3.3SiO_2$ | 2.1 | 2.1 | 1.7 | 2.1 |
| j | cellulose ether | 1.1 | 1.1 | 0.7 | 0.9 |
| k | optical brightener | 0.1 | 0.1 | 0.2 | 0.2 |
| l | Na sulfate, water and minor constituents | rest | rest | rest | rest |
| m | $NaBO_3.4H_2O$ | — | — | 15.0 | 25.0 |
| n | $NaBO_3.H_2O$ | 10.0 | 9.8 | 5.0 | — |
| o | TAED | 3.5 | 3.4 | 2.0 | 2.0 |
| P | enzyme | 0.5 | 0.5 | 0.5 | 0.6 |
| q | silicone | 0.2 | 0.2 | 0.2 | 0.2 |
| r | perfume | 0.2 | 0.2 | 0.2 | 0.2 |
| Throughput (t/h) | | 1.5 | 1.5 | 1.0 | 1.6 |
| Froude index | | 365 | 360 | 385 | 350 |
| Apparent density (g/l) | | | | | |
| TP before compaction | | 590 | 588 | 528 | 420 |
| TP after compaction | | 630 | 633 | 631 | 510 |
| Final mixture A | | 635 | 680 | 660 | 712 |
| Final mixture B | | 640 | 709 | 680 | — |

What is claimed is:

1. A process for producing a phosphate-reduced detergent product containing

A) 4–20% by weight of at least one anionic surfactant;

B) 2 to 20% by weight of at least one nonionic surfactant;

C) 20 to 50% by weight of at least one builder;

D) 3 to 25% by weight washing alkalis;

E) 0 to 30% by weight of other detergent constituents, which process comprises:

(1) continuously introducing a spray-dried detergent tower powder, the tower powder containing an anionic surfactant and not more than 50% by weight of the amount of component B) in the phosphate-reduced detergent product and not more than an amount of component B) comprising 5% by weight of the phosphate reduced detergent product, the tower powder having an apparent density of at least 350 grams/liter, into a cylindrical, substantially horizontal mixing drum having a smooth inner wall and having a shaft, mounted for axial rotation about a central axis of the mixing drum, equipped with radially arranged impact tools having a length (from the central axis) between about 80% and about 98% of the internal radius of said drum and regulating the rotational speed of the shaft at a Froude index of from about 100 to about 800 and a mean residence time of the tower powder in the mixing drum of 10 to 60 seconds at a constant tower powder throughput, wherein the Froude index is a dimensionless number equal to $$\frac{W^2 r}{g}$$

wherein W is the rotational speed of the shaft in radius per unit time, r is the length of the tools from the central axis, g is the gravitational constant and w, r and g are in consistent units;

(2) continuously introducing at least one nonionic surfactant, in a liquid state, into the mixing drum to form the detergent product without pulverizing or agglomerating the tower powder.

2. The process of claim 1 wherein the length of said rotating tools is between 85% and 96% of the internal radius of the drum.

3. The process of claim 1 wherein the apparent density of said tower powder introduced into the mixing drum is at least 400 g/l.

4. The process of claim 1 wherein the mean residence time of said powder in the drum is from 20 to 50 seconds.

5. The process of claim 1 wherein the Froude index is from 250 to 800.

6. The process of claim 1 wherein the temperature of the powder in the drum does not exceed 50° C.

7. The process of claim 1 further comprising adding from 0.5 to 3.0% by weight of the detergent of finely divided dry zeolite to the mixing drum.

8. The process of claim 1 wherein a mixture of at least two powder components are processed.

9. A process of claim 1 wherein the nonionic surfactant is introduced into the mixer through at least one opening in a wall of the mixer.

10. A process of claim 9 wherein the nonionic surfactant is introduced into the mixer through a plurality of openings.

* * * * *